US009512748B2

(12) United States Patent
Kim et al.

(10) Patent No.: US 9,512,748 B2
(45) Date of Patent: Dec. 6, 2016

(54) CONTINUOUS VARIABLE VALVE DURATION APPARATUS AND ENGINE PROVIDED WITH THE SAME

(71) Applicant: HYUNDAI MOTOR COMPANY, Seoul (KR)

(72) Inventors: Back Sik Kim, Osan-si (KR); Kyoung Pyo Ha, Seoul (KR); In Sang Ryu, Hwaseong-si (KR); Dae Sung Kim, Hwaseong-si (KR); Ingee Suh, Yongin-si (KR); Ki-Young Kwon, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 210 days.

(21) Appl. No.: 14/559,762

(22) Filed: Dec. 3, 2014

(65) Prior Publication Data

US 2016/0090877 A1 Mar. 31, 2016

(30) Foreign Application Priority Data

Sep. 30, 2014 (KR) ..... 10-2014-0131640

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 1/356*** | (2006.01) |
| ***F01L 13/00*** | (2006.01) |

(52) U.S. Cl.

CPC ..... *F01L 1/34413* (2013.01); *F01L 1/047* (2013.01); *F01L 1/356* (2013.01); *F01L 13/0015* (2013.01); *F01L 2001/34496* (2013.01); *F01L 2013/0084* (2013.01)

(58) Field of Classification Search

CPC ..... F01L 1/047; F01L 1/356; F01L 1/34413; F01L 2013/0084

USPC ..... 123/90.16, 90.18, 90.27, 90.31

See application file for complete search history.

(56) References Cited

U.S. PATENT DOCUMENTS

| | | | |
|---|---|---|---|
| 5,333,579 | A | 8/1994 | Hara et al. |
| 5,365,896 | A | 11/1994 | Hara et al. |
| 5,494,009 | A | 2/1996 | Yamada et al. |
| 5,553,573 | A | 9/1996 | Hara et al. |
| 5,557,983 | A | 9/1996 | Hara et al. |

(Continued)

FOREIGN PATENT DOCUMENTS

| | | | |
|---|---|---|---|
| JP | 2005-226540 | A | 8/2005 |
| JP | 5028355 | B2 | 9/2012 |

(Continued)

*Primary Examiner* — Ching Chang

(74) *Attorney, Agent, or Firm* — McDermott Will & Emery LLP

(57) ABSTRACT

A continuous variable valve duration apparatus includes a camshaft. A slider, which is mounted to the camshaft, has a camshaft sliding key and a cam portion of which a cam and a cam sliding key are formed thereto. The camshaft is inserted into the cam portion, and a relative phase between the cam and the camshaft is variable. A roller ring is connected with the camshaft sliding key and the cam sliding key. The roller ring is rotatably inserted into a roller ring guider, and the roller ring guider slidably inserted into a cylinder head. A control portion selectively changes a position of the roller ring guider to control a rotation center position of the roller ring.

18 Claims, 7 Drawing Sheets

(56) References Cited

U.S. PATENT DOCUMENTS

| | | | | |
|---|---|---|---|---|
| 5,592,908 | A | 1/1997 | Hara et al. | |
| 5,622,144 | A | 4/1997 | Nakamura et al. | |
| 5,636,603 | A | 6/1997 | Nakamura et al. | |
| 5,687,681 | A | 11/1997 | Hara | |
| 5,709,179 | A | 1/1998 | Hara et al. | |
| 5,778,840 | A | 7/1998 | Murata et al. | |
| 5,924,334 | A | 7/1999 | Hara et al. | |
| 6,401,675 | B1 | 6/2002 | Nakamura et al. | |
| 6,425,357 | B2 | 7/2002 | Shimizu et al. | |
| 6,907,852 | B2 | 6/2005 | Schleusener et al. | |
| 8,813,704 | B2 * | 8/2014 | Kim | F01L 1/0532 123/90.16 |

FOREIGN PATENT DOCUMENTS

| | | | |
|---|---|---|---|
| JP | 05-118208 | A | 5/2013 |
| KR | 10-0969074 | B1 | 7/2010 |
| KR | 10-1326818 | B1 | 11/2013 |

* cited by examiner

CONTINUOUS VARIABLE VALVE DURATION APPARATUS AND ENGINE PROVIDED WITH THE SAME

CROSS-REFERENCE TO RELATED APPLICATION

This application claims the benefit of priority to Korean Patent Application No. 10-2014-0131640 filed in the Korean Intellectual Property Office on Sep. 30, 2014, the entire contents of which are incorporated herein by reference.

TECHNICAL FIELD

The present disclosure relates to a continuous variable valve duration apparatus. More particularly, the present disclosure relates to a continuous variable valve duration apparatus which may vary an opening duration of a valve according to operation conditions of an engine with a simple construction.

BACKGROUND

An internal combustion engine generates power by burning a fuel in a combustion chamber by drawing air into the chamber. Intake valves intake the air by rotation of a camshaft, and the air is drawn into the combustion chamber while the intake valves are opened. In addition, exhaust valves allows combustion gas out by the rotation of the camshaft, and the gas is exhausted from the combustion chamber while the exhaust valves are opened.

The optimal operation of the intake valves and the exhaust valves depends on a rotation speed of the engine. In order to achieve such an optimal valve operation depending on the rotation speed of the engine, various researches, such as designing of a plurality of cams and a continuous variable valve lift (CVVL) that can change valve lift according to engine speed, have been undertaken.

Further, in order to achieve such an optimal valve operation depending on the rotation speed of the engine, a continuously variable valve timing (CVVT) apparatus that enables different valve timing operations depending on the engine speed has been developed. The general CVVT may change valve timing with a fixed valve opening duration.

However, the general CVVL and CVVT have a complicated structure and manufacturing cost is high.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide a continuous variable valve duration apparatus which may vary an opening duration of a valve according to operation conditions of an engine with a simple construction.

A continuous variable valve duration apparatus according to an exemplary embodiment of the present inventive concept may include a camshaft. A slider is mounted to the camshaft and has a camshaft sliding key. A cam portion includes a cam and a cam sliding key. The camshaft is inserted into the cam portion, and a relative phase between the cam and the camshaft is variable. A roller ring is connected with the camshaft sliding key and the cam sliding key. A roller ring guider has the roller ring rotatably inserted thereto, and the roller ring guider slidably inserted into a cylinder head. A control portion selectively changes a position of the roller ring guider to control a rotation center position of the roller ring.

The continuous variable valve duration apparatus may further include a first pin having a sliding key slot for the camshaft sliding key to be slidably inserted into and a second pin having a sliding key slot for the cam sliding key to be slidably inserted into. A first sliding pin hole and a second sliding pin hole for the first pin and the second pin to be inserted thereto respectively may be formed to the roller ring.

The first and the second pins may have a cylinder shape and the first and second sliding pin holes may be formed for the first and second pins to be rotatable therewithin.

The sliding key slots of the first and second pins may be opposite directions from each other.

A part of the first and second sliding pin holes may be opened for movements of the camshaft sliding key and the cam sliding key not to be interrupted.

A needle bearing may be is disposed between the roller ring guider and the roller ring.

The control portion may include an eccentric shaft parallel to the camshaft and a slot into which the eccentric shaft is inserted may be formed to the roller ring guider.

The control portion may further include a worm wheel mounted to the eccentric shaft, a worm gear engaged with the worm wheel and a motor selectively rotating the worm gear.

The cam may be provided in plural.

The cam portion may have a cam cap engaging portion for engaging with a cam cap.

The slider may be connected with the camshaft through a connecting pin.

An engine according to another exemplary embodiment of the present inventive concept may include a camshaft. A slider is mounted to the camshaft and has a camshaft sliding key. A cam portion includes a cam and a cam sliding key. The camshaft is inserted into the cam portion, and a relative phase between the cam and the camshaft is variable. A roller ring is connected with the camshaft sliding key and the cam sliding key. A roller ring guider includes the roller ring is rotatably inserted thereto. The roller ring guider is slidably inserted into a cylinder head, and includes a first and a second sliding pin holes. A sliding key slot includes a first pin for the camshaft sliding key to be slidably inserted thereto, and the first pin is rotatably inserted into the first sliding pin hole. A sliding key slot includes second pin for the cam sliding key to be slidably inserted in an opposite direction of the sliding key slot of the first pin. The second pin is rotatably inserted into the second sliding pin hole. A control portion selectively changes a position of the roller ring guider to control a rotation center position of the roller ring.

A part of the first and second sliding pin holes may be opened for movements of the camshaft sliding key and the cam sliding key not to be interrupted.

A needle bearing may be disposed between the roller ring guider and the roller ring.

The control portion may include an eccentric shaft parallel to the camshaft, and the roller ring guider includes a slot of which the eccentric shaft is inserted thereinto.

The control portion may further include a worm wheel mounted to the eccentric shaft, a worm gear engaged with the worm wheel and a motor selectively rotating the worm gear.

The cylinder head may include a mounting surface and the roller ring guider may include a sliding surface. The sliding surface may be guided along the mounting surface such that the roller ring guider may be mounted to the cylinder head.

The engine may further include a continuous variable timing device connected with an end of the camshaft.

As described above, the continuous variable valve duration apparatus according to the exemplary embodiment of the present inventive concept may vary an opening duration of a valve according to operation conditions of an engine with a simple construction.

The continuous variable valve duration apparatus according to the exemplary embodiment of the present inventive concept may be reduced in size, and thus, the entire height of a valve train may be reduced.

The continuous variable valve duration apparatus according to the exemplary embodiment of the present inventive concept may be applied without excessive changing shapes of a cam and a valve train, and thus, productivity may be enhanced and production cost may be reduced.

According to mounting angle of the roller ring guider applied to the continuous variable valve duration apparatus of the exemplary embodiment of the present inventive concept, various valve profiles may be achieved.

DETAILED DESCRIPTION

Figure 1:
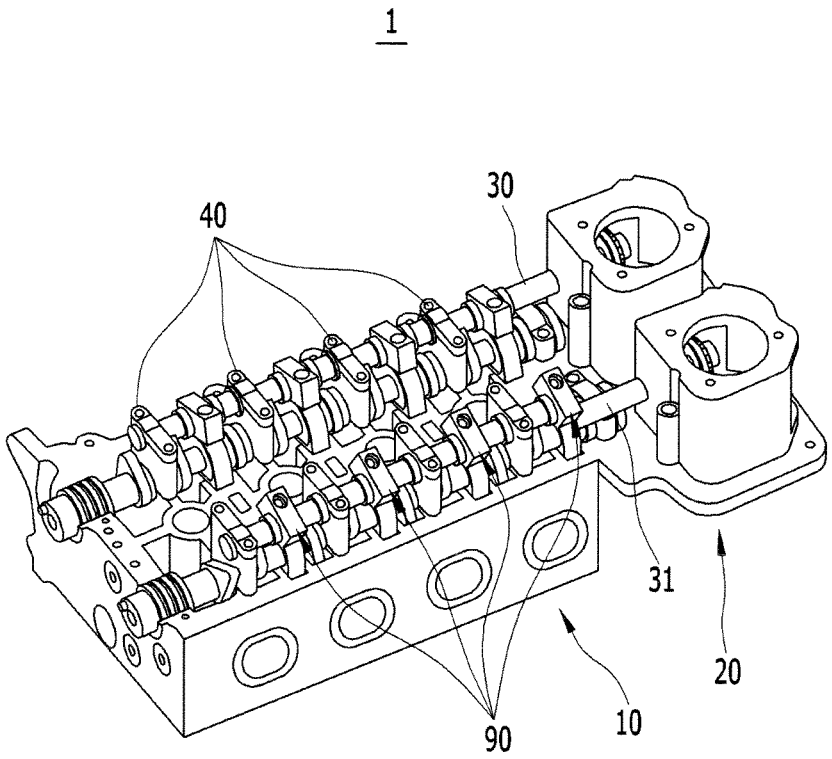
FIG. 1 is a perspective view of an engine provided with a continuous variable valve duration apparatus according to an exemplary embodiment of the present inventive concept.

In the following detailed description, only certain exemplary embodiments of the present inventive concept have been shown and described, simply by way of illustration.

As those skilled in the art would realize, the described embodiments may be modified in various different ways, all without departing from the spirit or scope of the present inventive concept.

A part irrelevant to the description will be omitted to clearly describe the present disclosure, and the same or similar elements will be designated by the same reference numerals throughout the specification.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification and the claims, unless explicitly described to the contrary, the word "comprise" and variations such as "comprises" or "comprising" will be understood to imply the inclusion of stated elements but not the exclusion of any other elements.

An exemplary embodiment of the present inventive concept will hereinafter be described in detail with reference to the accompanying drawings.

Figure 2:
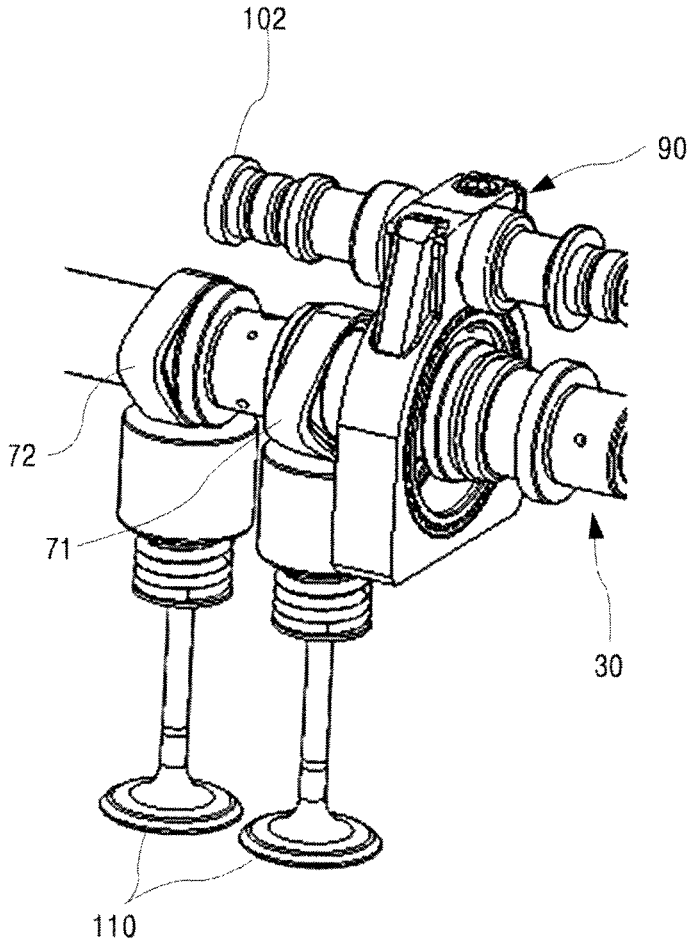
FIG. 2 is a perspective view of a continuous variable valve duration apparatus according to an exemplary embodiment of the present inventive concept.
Figure 3:
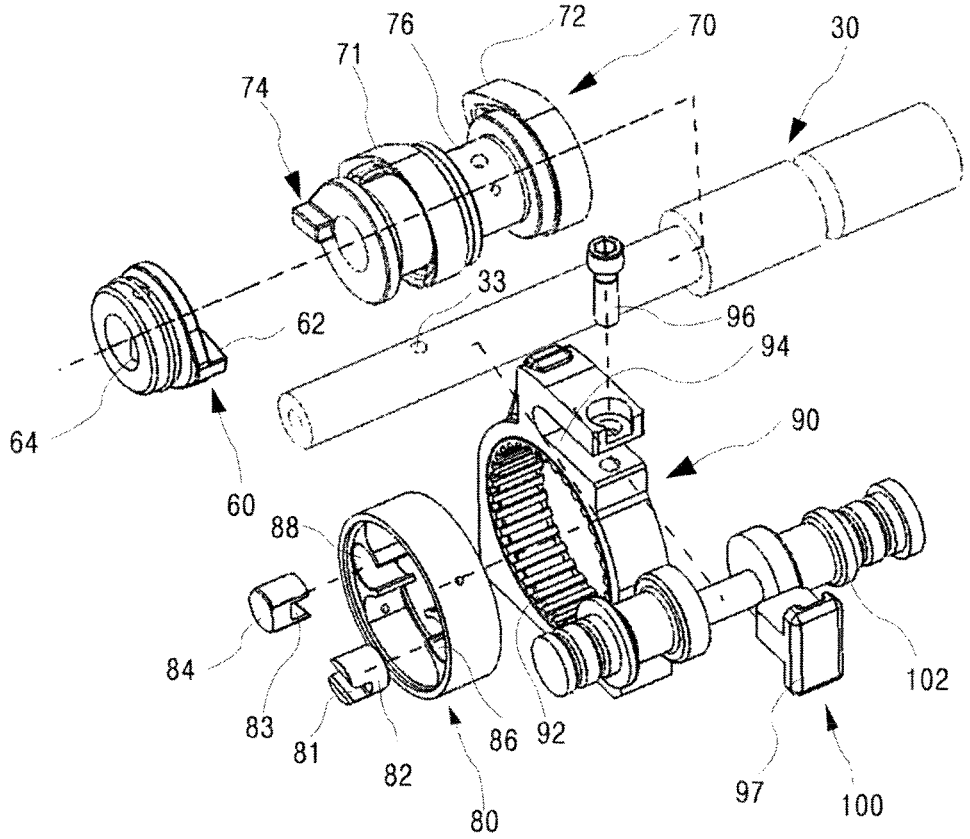
FIG. 3 is an exploded perspective view of a continuous variable valve duration apparatus according to an exemplary embodiment of the present inventive concept.

FIG. 1 is a perspective view of an engine provided with a continuous variable valve duration apparatus according to an exemplary embodiment of the present inventive concept, FIG. 2 is a perspective view of a continuous variable valve duration apparatus according to an exemplary embodiment of the present inventive concept, and FIG. 3 is an exploded perspective view of a continuous variable valve duration apparatus according to an exemplary embodiment of the present inventive concept.

Referring to FIGS. 1 to 3, a continuous variable valve duration apparatus which may applied to an engine 1 according to an exemplary embodiment of the present inventive concept includes a camshaft 30 and/or 31, a slider 60 mounted to the camshaft 30 and or 31 and of which a camshaft sliding key 62 is formed thereto. A cam portion 70 includes a cam 70 and/or 71 and a cam sliding key 74 formed thereto, of which the camshaft 30 and/or 31 is inserted into the cam portion 70. A relative phase between the cam 70 and/or 71 and the camshaft 30 and/or 31 are variable. A roller ring 80 is connected with the camshaft sliding key 62 and the cam sliding key 74, a roller ring guider 90 of which the roller ring 80 is rotatably inserted thereto. The roller ring guider 90 is slidably inserted into a cylinder head 10 and a control portion 100 selectively changing a position of the roller ring guider 90 to control a rotation center position of the roller ring 80.

The camshaft 30 and 31 are an intake camshaft and an exhaust camshaft. The continuous variable valve duration apparatus may be mounted to the intake camshaft or to the intake camshaft and the exhaust camshaft.

In the drawings, two cams 71 and 72 are drawn, but is not limited thereto.

A cam cap engaging portion 76 is formed to the cam portion 70 for engaging with a cam cap 40. In the drawings, the cam cap engaging portion 76 is formed between the cams 71 and 72, but is not limited thereto.

Valves 110 are opened and closed by operations of the cams 71 and 72.

An engaging hole 33 is formed to the camshaft 30, and the slider 60 is connected with the camshaft 30 through a connecting pin 64 inserted into the engaging hole 33.

The continuous variable valve duration apparatus further includes a first pin 82 of which a sliding key slot 81 for the camshaft sliding key 62 to be slidably inserted is formed thereto and a second pin 84 of which a sliding key slot 83 for the cam sliding key 74 to be slidably inserted is formed thereto. First and second sliding pin holes 86 and 88 for the first pin 82 and the second pin 84 to be inserted thereto respectively are formed to the roller ring 80.

The first and the second pins 82 and 84 have a cylinder shape, and the first and second sliding pin holes 86 and 88 are formed for the first and second pins 82 and 84 to be rotatable therewithin. The first and second pins 82 and 84 and the first and second sliding pin holes 86 and 88 have a circular cylinder shape, and thus, anti-abrasion characteristic may be improved.

In addition, simple shapes of the first and second pins 82 and 84 and the first and second sliding pin holes 86 and 88 may improve productivity.

The sliding key slots 81 and 83 of the first and second pins 82 and 84 formed opposite directions from each other, and the camshaft sliding key 62 and the cam sliding key 74 are inserted into thereto respectively.

A part of the first and second sliding pin holes 86 and 88 are opened to maintain movements of the camshaft sliding key 62 and the cam sliding key 74.

A needle bearing 92 is disposed between the roller ring guider 90 and the roller ring 80, and thus, relative rotations between the roller ring guider 90 and the roller ring 80 may be easily achieved and rigidity also may be secured.

The engine 1 may further include a continuous variable timing device 20 mounted to an end of the camshaft 30 and/or 31.

Figure 4:
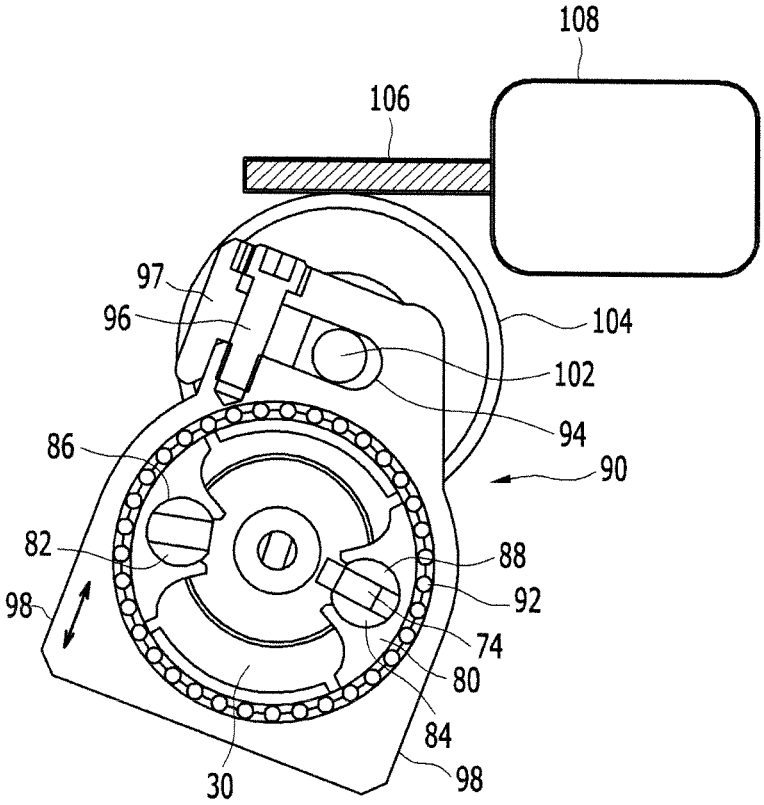
FIG. 4 is a drawing showing a control portion of a continuous variable valve duration apparatus according to an exemplary embodiment of the present inventive concept.
Figure 5:
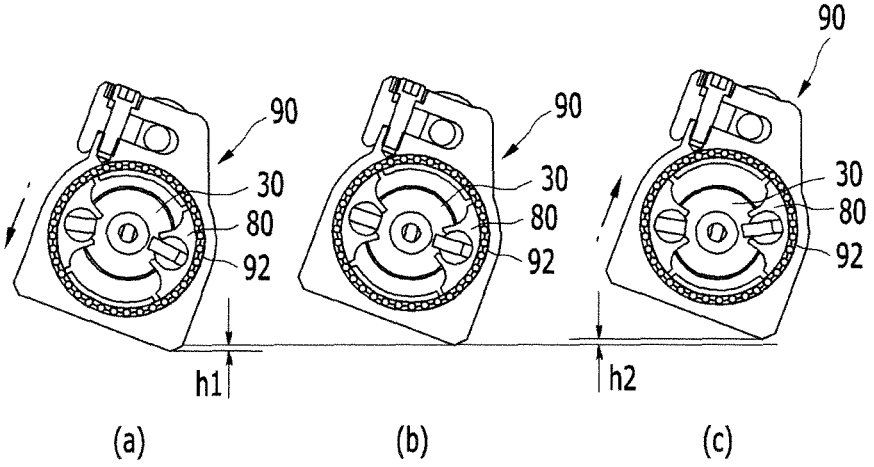
FIG. 5 is a drawing showing operations of a continuous variable valve duration apparatus according to an exemplary embodiment of the present inventive concept.
Figure 6:
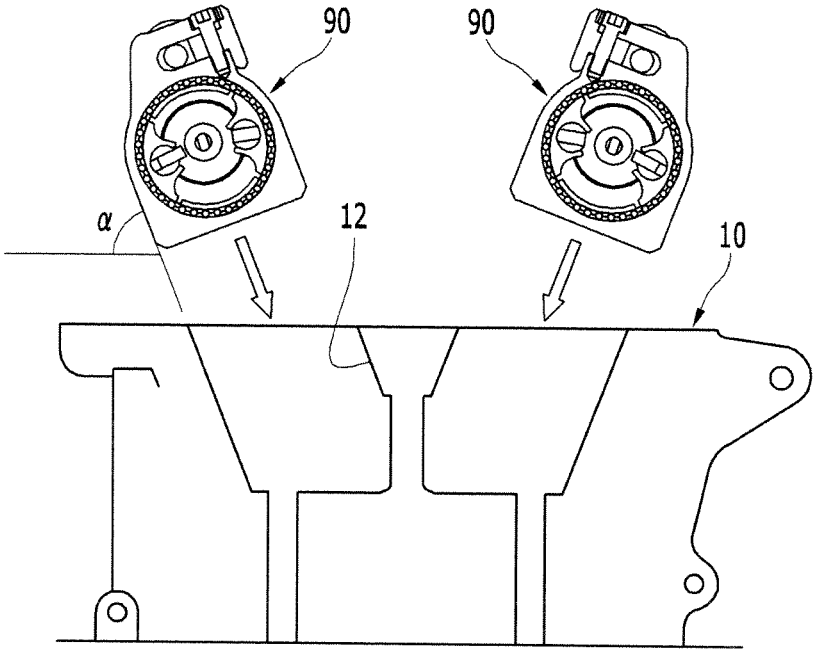
FIG. 6 is a drawing showing assembling processes of a continuous variable valve duration apparatus according to an exemplary embodiment of the present inventive concept.

FIG. 4 is a drawing showing a control portion of a continuous variable valve duration apparatus according to an exemplary embodiment of the present inventive concept, FIG. 5 is a drawing showing operations of a continuous variable valve duration apparatus according to an exemplary embodiment of the present inventive concept, and FIG. 6 is a drawing showing assembling processes of a continuous variable valve duration apparatus according to an exemplary embodiment of the present inventive concept.

Referring to FIGS. 1 to 6, the control portion 100 includes an eccentric shaft 102 parallel to the camshaft 30 and a slot 94 of which the eccentric shaft 102 is inserted thereinto is formed to the roller ring guider 90. Thus, hinge elements for controlling positions of the roller ring guider 90 and so on may be eliminated, and manufacturing processes may be reduced.

A fastener 97 is mounted to the roller ring guider 90 to block an end of the slot 94, and an engage bolt 96 engages the fastener 97 for preventing the eccentric shaft 102 from being separated from the slot 94.

the control portion 100 further includes a worm wheel 104 mounted to the eccentric shaft 102, a worm gear 106 engaged with the worm wheel 104 and a motor 108 selectively rotating the worm gear 106.

A mounting surface 12 is formed on the cylinder head 10 and a sliding surface 98 is formed on the roller ring guider 90. The sliding surface 98 is guided along the mounting surface 12 so that the roller ring guider 90 is mounted to the cylinder head 10. With those schemes, mounting processes for the roller ring guider 90 may be simplified.

Referring to FIGS. 1 to 5, operations of the continuous variable valve duration apparatus according to an exemplary embodiment of the present inventive concept will be discussed.

According to engine operation conditions, the motor 108 of the control portion 100 rotates to change a relative position of the roller ring guider 90.

For example, as shown in FIG. 5, according to the rotation of the motor 108, the eccentric shaft 102 rotates to change the relative position of the roller ring guider 90 downwardly (h1) or upwardly (h2). The position of the rotation center of the roller ring 80 with respect to the position of rotation center of the camshaft 30 is changed, and a rotation acceleration (angular acceleration) of the cam portion 70 in phase is changed, that is, a valve duration is changed.

Figure 7A:
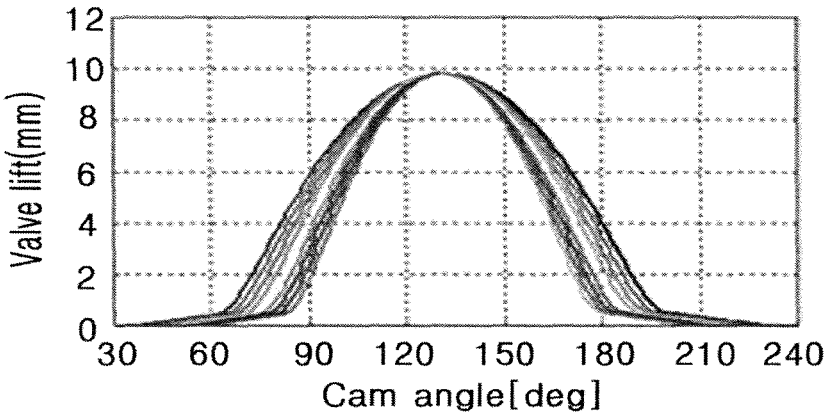
FIGS. 7(A) and 7(B) are graphs of valve profile of a continuous variable valve duration apparatus according to an exemplary embodiment of the present inventive concept.
Figure 7B:
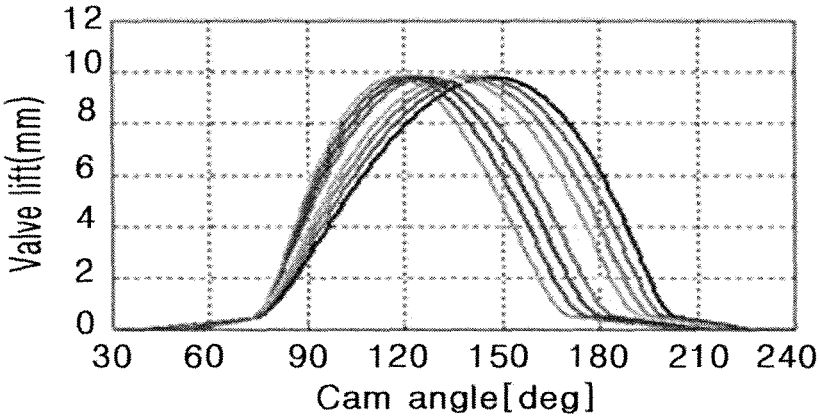

FIGS. 7(A) and 7(B) are graphs of valve profile of a continuous variable valve duration apparatus according to an exemplary embodiment of the present inventive concept.

Various valve profiles of the continuous variable valve duration apparatus according to an exemplary embodiment of the present inventive concept may be achieved according to a relative mounting angle a of the roller ring guider 90 with respect to the cylinder head 10 as shown in FIG. 6.

As shown in FIG. 7(A), if the relative mounting angle a of the roller ring guider 90 with respect to the cylinder head 10 is coincident to a mounting angle of the valve 100, opening and closing of the valve 100 are symmetric.

As shown in FIG. 7(B), if the relative mounting angle a of the roller ring guider 90 with respect to the cylinder head 10 is adjusted to fix closing time of the valve 100, asymmetric valve profiles are achieved.

The engine 1 according to an exemplary embodiment of the present inventive concept may further include the continuous variable timing device 20. If the operation of the continuous variable timing device 20 is adjusted, various valve profiles combined by the valve profiles as shown in (A) and (B) of FIG. 7 may be achieved.

The operations of the continuous variable timing device is obvious to a person skilled in the art, thus detailed description will be omitted.

While this inventive concept has been described in connection with what is presently considered to be practical exemplary embodiments, it is to be understood that the inventive concept is not limited to the disclosed embodiments. On the contrary, it is intended to cover various modifications and equivalent arrangements included within the spirit and scope of the appended claims.

What is claimed is:

1. A continuous variable valve duration apparatus comprising:

a camshaft;

a slider mounted to the camshaft and having a camshaft sliding key;

a cam portion having a cam and a cam sliding key, into which the camshaft is inserted, and having a variable relative phase between the cam and the camshaft;

a roller ring connected with the camshaft sliding key and the cam sliding key;

a roller ring guider into which the roller ring is rotatably inserted, the roller ring guider being slidably inserted into a cylinder head; and a control portion selectively changing a position of the roller ring guider to control a rotation center position of the roller ring.

2. The apparatus of claim 1, further comprising:

a first pin having a sliding key slot for the camshaft sliding key to be slidably inserted thereto; and a second pin having a sliding key slot for the cam sliding key to be slidably inserted thereto, wherein the roller ring includes a first sliding pin hole and a second sliding pin hole for the first pin and the second pin to be inserted thereto, respectively.

3. The apparatus of claim 2, wherein:

the first and the second pins have a cylinder shape; and the first and second pins rotate in the first and second sliding pin holes.

4. The apparatus of claim 3, wherein the sliding key slots of the first and second pins are disposed opposite directions from each other.

5. The apparatus of claim 4, wherein a part of the first and second sliding pin holes are opened for movements of the camshaft sliding key and the cam sliding key not to be interrupted.

6. The apparatus of claim 1, wherein a needle bearing is disposed between the roller ring guider and the roller ring.

7. The apparatus of claim 1, wherein:

the control portion comprises an eccentric shaft parallel to the camshaft; and the roller ring guider includes a slot into which the eccentric shaft is inserted.

8. The apparatus of claim 7, wherein the control portion further comprises:

a worm wheel mounted to the eccentric shaft;

a worm gear engaged with the worm wheel; and a motor selectively rotating the worm gear.

9. The apparatus of claim 1, wherein the cam is provided in plural.

10. The apparatus of claim 1, wherein the cam portion has a cam cap engaging portion for engaging with a cam cap.

11. The apparatus of claim 1, wherein the slider is connected with the camshaft through a connecting pin.

12. An engine comprising:

a camshaft;

a slider mounted to the camshaft and having a camshaft sliding key;

a cam portion having a cam and a cam sliding key, into which the camshaft is inserted, and having a variable relative phase between the cam and the camshaft;

a roller ring connected with the camshaft sliding key and the cam sliding key;

a roller ring guider to which the roller ring is rotatably inserted, the roller ring guider slidably inserted into a cylinder head, and roller ring having a first sliding pin hole and a second sliding pin hole;

a first pin of which a sliding key slot for the camshaft sliding key to be slidably inserted is formed thereto, and the first pin rotatably inserted into the first sliding pin hole;

a second pin of which a sliding key slot for the cam sliding key to be slidably inserted is formed in the opposite direction of the sliding key slot of the first pin, and the second pin rotatably inserted into the second sliding pin hole; and a control portion selectively changing a position of the roller ring guider to control a rotation center position of the roller ring.

13. The engine of claim 12, wherein a part of the first and second sliding pin holes are opened for movements of the camshaft sliding key and the cam sliding key not to be interrupted.

14. The engine of claim 13, wherein:

the cylinder includes a mounting surface; and the roller ring guider includes a sliding surface, wherein the sliding surface is guided along the mounting surface such that the roller ring guider is mounted to the cylinder head.

15. The engine of claim 13, further comprising a continuous variable timing device connected with an end of the camshaft.

16. The engine of claim 12, wherein a needle bearing is disposed between the roller ring guider and the roller ring.

17. The engine of claim 12, wherein:

the control portion comprises an eccentric shaft parallel to the camshaft; and the roller ring guider has a slot into which the eccentric shaft is inserted.

18. The engine of claim 17, wherein the control portion further comprises:

a worm wheel mounted to the eccentric shaft;

a worm gear engaged with the worm wheel; and a motor selectively rotating the worm gear.

* * * * *